US007316217B2

(12) United States Patent
Yamada

(10) Patent No.: US 7,316,217 B2
(45) Date of Patent: Jan. 8, 2008

(54) CONTROL DEVICE OF INTERNAL COMBUSTION ENGINE

(75) Inventor: Kazumi Yamada, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/287,312

(22) Filed: Nov. 28, 2005

(65) Prior Publication Data

US 2006/0124105 A1 Jun. 15, 2006

(30) Foreign Application Priority Data

Dec. 10, 2004 (JP) ..... 2004-358720

(51) Int. Cl.
*F02D 43/00* (2006.01)
*F02D 45/00* (2006.01)
*F02D 11/10* (2006.01)

(52) U.S. Cl. ..... 123/397; 123/198 D; 123/399

(58) Field of Classification Search ..... 123/198 D, 123/198 DB, 361, 397, 399
See application file for complete search history.

(56) References Cited

U.S. PATENT DOCUMENTS 5,255,653 A * 10/1993 Ironside et al. ..... 123/399
2001/0042535 A1 11/2001 Yamazaki et al.
2002/0165659 A1 11/2002 Boggs et al.
2002/0165660 A1 11/2002 Boggs et al.
2002/0179031 A1 12/2002 Slopsema et al.
2004/0149245 A1 8/2004 Moriya

FOREIGN PATENT DOCUMENTS

| | | |
|---|---|---|
| DE | 197 35 455 C1 | 11/1998 |
| EP | 1 154 154 A2 | 11/2001 |
| EP | 1 396 622 A1 | 3/2004 |
| JP | A 3-78563 | 4/1991 |
| JP | A 6-137197 | 5/1994 |
| JP | A 63-34241 | 2/1998 |
| JP | A 11-107794 | 4/1999 |
| JP | A 2000-87770 | 3/2000 |
| JP | A 2000-104651 | 4/2000 |

* cited by examiner

*Primary Examiner*—T. M Argenbright
(74) *Attorney, Agent, or Firm*—Oliff & Berridge, PLC

(57) ABSTRACT

An ECU performs stop control for operating an engine for a prescribed time after an ignition switch is turned off. During performance of the stop control of the engine, the ECU prohibits an update of an accelerator press-down degree signal and controls an opening degree of a throttle valve such that, the opening degree of the throttle valve becomes constant regardless of an amount of pressing-down of an accelerator pedal, in order to prevent a variation in an output of the engine due to an operation of the accelerator pedal.

16 Claims, 3 Drawing Sheets

CONTROL DEVICE OF INTERNAL COMBUSTION ENGINE

This nonprovisional application is based on Japanese Patent Application No. 2004-358720 filed with the Japan Patent Office on Dec. 10, 2004, the entire contents of which are hereby incorporated by reference.

BACKGROUND OF THE INVENTION

1. Field of the Invention

The present invention relates to a control device of an internal combustion engine. More specifically, the present invention relates to a control device performing stop control for operating an internal combustion engine for a prescribed period after an ignition switch is turned off.

2. Description of the Background Art

Japanese Patent Laying-Open No. 2000-104651 discloses an ignition device for operating an engine for a certain time after an ignition switch is turned off The ignition device includes an engine control unit (hereafter referred to as an "ECU") for controlling ignition of a spark plug and fuel injection, an ignition switch, an ECU relay for supplying/cutting off operating power to the ECU, an ignition coil, a spark plug, and an ignition coil relay. The ignition switch and the ECU relay are provided in parallel between a battery power supply and the ECU. The ignition coil relay is provided between the battery power supply and the ignition coil, and receives an operation instruction from the ECU.

In the ignition device, power is supplied to the ignition coil via the ignition coil relay controlled by the ECU. When ignition by the spark plug is performed for a predetermined number of times after turning-off of the ignition switch, the ignition coil relay is turned off by the ECU.

According to the ignition device, since ignition of the spark plug is performed for a predetermined number of times after the ignition switch is turned off, operability and exhaust properties at restarting of the engine can be prevented from being deteriorated due to injected fuel which remains inside a cylinder of the engine without attaining combustion.

A driver of a vehicle, however, understands that the engine is stopped at a time of turning-off of the ignition switch. In the ignition device described above, when an accelerator pedal is pressed down after the ignition switch is turned off, an amount of intake air of the engine is increased and, since ignition is continued, an output of the engine is increased contrary to an intention of the driver.

SUMMARY OF THE INVENTION

The present invention is made to solve the above-described problem. An object of the present invention is to provide a control device of an internal combustion engine which prevents a variation in an output of the internal combustion engine based on an operation of an accelerator during stop control for operating the internal combustion engine for a prescribed period after an ignition switch is turned off.

According to the present invention, a control device of an internal combustion engine having an output varying corresponding to an operation of an accelerator pedal includes a control portion invalidating an operation of the accelerator pedal during performance of stop control for operating an internal combustion engine for a prescribed period after an ignition switch is turned off.

The control portion preferably prohibits reception of an accelerator press-down degree signal which varies corresponding to an amount of operation of the accelerator pedal during performance of the stop control.

The control portion preferably sets a value of an accelerator press-down degree signal which varies corresponding to an amount of operation of the accelerator pedal to a minimum value during performance of the stop control.

The control portion preferably controls to set an opening degree of a throttle valve which adjusts an intake amount of the internal combustion engine to a constant value during performance of the stop control.

The control portion preferably controls to set the opening degree of the throttle valve to a state at turning-off of the ignition switch during performance of the stop control.

The control portion preferably controls to set the opening degree of the throttle valve to a state in idling of the internal combustion engine during performance of the stop control.

The control portion preferably controls to set an amount of injection of fuel supplied to the internal combustion engine to a constant value during performance of the stop control.

The control portion preferably stops injection of fuel supplied to the internal combustion engine during performance of the stop control.

In the control device of an internal combustion engine according to the present invention, the control portion performs stop control for operating the internal combustion engine for a prescribed period after the ignition switch is turned off. Since the control portion invalidates an operation of the accelerator pedal which causes a variation in an output of the internal combustion engine during performance of the stop control, the output of the internal combustion engine is not increased when the accelerator pedal is pressed down during performance of the stop control.

Therefore, according to the present invention, a variation in the output of the internal combustion engine which is not expected by a driver can be prevented.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
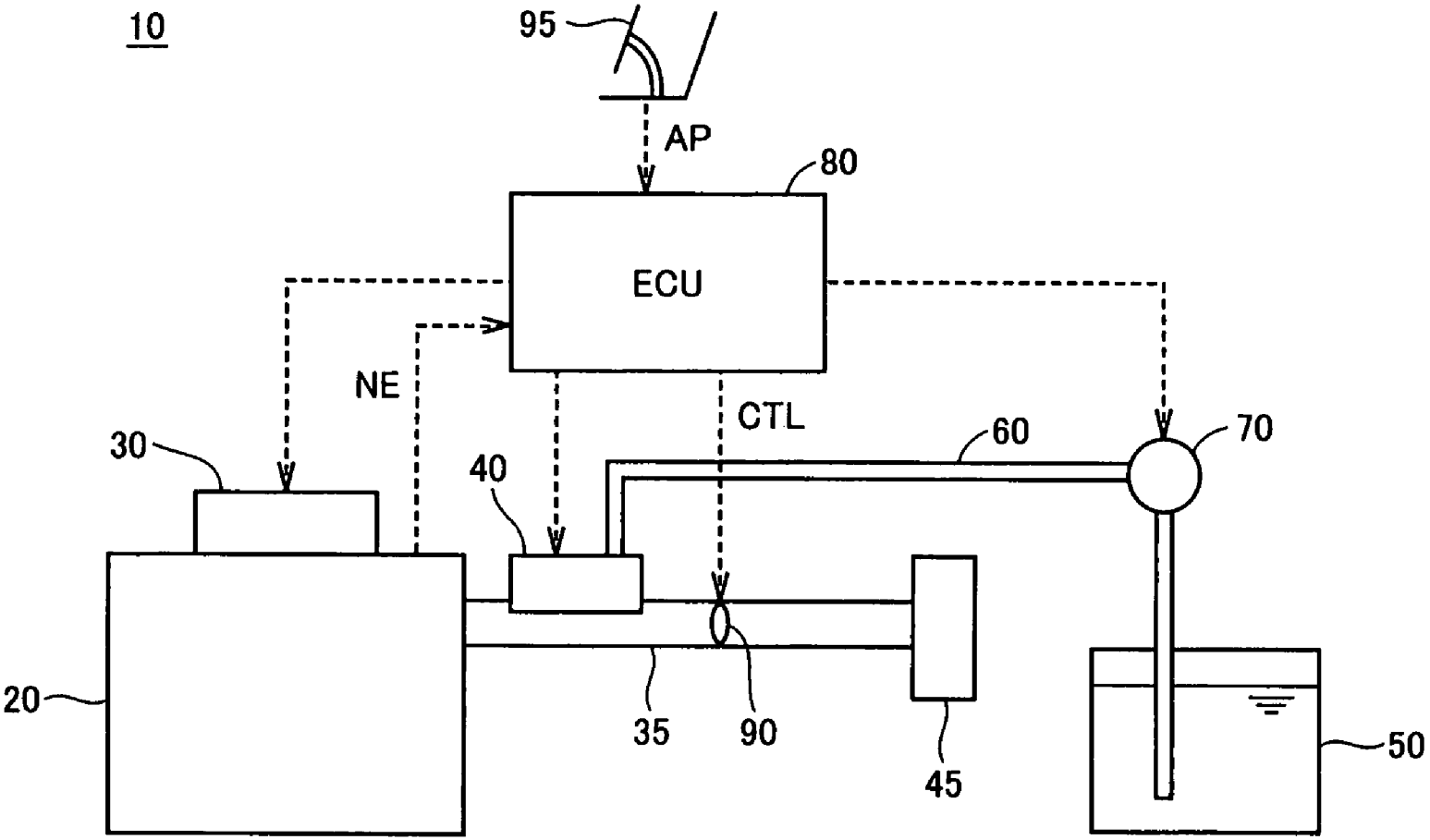
FIG. 1 shows a whole construction of an engine system controlled by a control device according to an embodiment of the present invention.

An embodiment of the present invention will now be described in detail referring to the drawings. It is to be noted that, the same or corresponding portions in the drawings are indicated with the same characters and descriptions thereof will not be repeated.

FIG. 1 shows a whole construction of an engine system controlled by a control device according to the embodiment of the present invention. Referring to FIG. 1, an engine system 10 includes an engine 20, an ignition device 30, an intake duct 35, an injection device 40, an air cleaner 45, a fuel tank 50, a delivery pipe 60, a fuel pump 70, an ECU 80, a throttle valve 90, and an accelerator pedal 95.

Engine 20 generates mechanical power of a vehicle on which this engine system 10 is mounted. Ignition device 30 includes an ignitor for generating a high voltage and a spark plug for generating a spark using the high voltage from the ignitor (both are not shown), and causes ignition based on a control instruction from ECU 80 to burn a mixture inside a cylinder of engine 20.

Injection device 40 includes an injector injecting particles of fuel, and injects fuel supplied from delivery pipe 60 into air supplied from intake duct 35 to engine 20 based on a control instruction from ECU 80. With this, a mixture of air and fuel is generated, and the generated mixture is supplied into the cylinder of engine 20.

Intake duct 35 is an intake pipe for supplying air to engine 20. Throttle valve 90 is provided in intake duct 35 and adjusts an amount of air supplied to engine 20 based on an opening degree instruction CTL from ECU 80. Air cleaner 45 is connected to intake duct 35 and removes a contaminant included in air supplied via intake duct 35 to engine 20.

Fuel tank 50 is a tank for storing fuel, and delivery pipe 60 is a fuel supply pipe for supplying fuel inside fuel tank 50 to injection device 40. Fuel pump 70 is formed with an electric pump and provided on delivery pipe 60. Fuel pump 70 operates based on an operation instruction from ECU 80, and supplies fuel inside fuel tank 50 to injection device 40 via delivery pipe 60.

ECU 80 controls operations of throttle valve 90, ignition device 30 and injection device 40 based on an accelerator press-down degree signal AP indicating a press-down degree of accelerator pedal 95 and a signal NE indicating a rotation speed of engine 20, and operates engine 20 with a desired rotation speed. The press-down degree of accelerator pedal 95 is detected with an accelerator press-down degree sensor, which is not shown, and the rotation speed of engine 20 is detected with a rotation number sensor, which is not shown.

In addition, when engine 20 is stopped, ECU 80 performs stop control for operating ignition device 30 and injection device 40 for a prescribed period after an ignition switch is turned off. This will be described below in detail.

In this engine system 10, a mixture of air supplied from intake duct 35 and fuel supplied from fuel tank 50 is generated by injection device 40, and the mixture is supplied to engine 20. Then, ignition device 30 causes ignition in a prescribed timing based on the control instruction from ECU 80 to bum the mixture supplied to engine 20.

ECU 80 also generates opening degree instruction CTL of throttle valve 90 based on accelerator press-down degree signal AP from accelerator pedal 95, and outputs the generated opening degree instruction CTL to throttle valve 90. With this, an intake amount of engine 20 is adjusted corresponding to an amount of pressing down of accelerator pedal 95 to control the rotation speed of engine 20.

Figure 2:
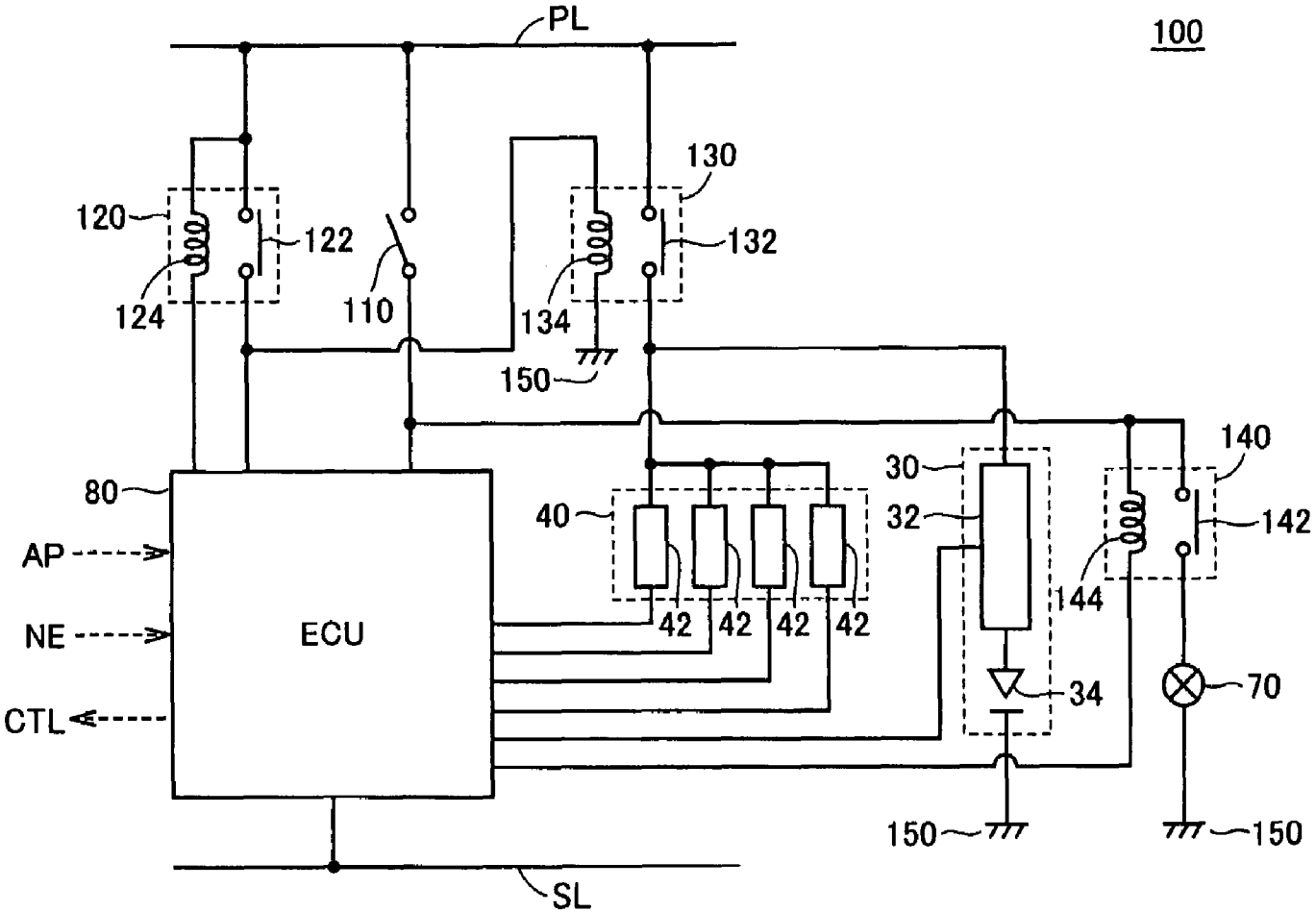
FIG. 2 is a functional block diagram of the control device controlling the engine system shown in FIG. 1.

FIG. 2 is a functional block diagram of the control device controlling engine system 10 shown in FIG. 1. Referring to FIG. 2, a control device 100 includes an ignition switch 110, a main relay 120, an ignition and injection relay 130, ignition device 30, injection device 40, a pump drive relay 140, fuel pump 70, ECU 80, a power supply line PL, and a ground line SL.

Power supply line PL is connected to a positive electrode terminal of a battery (not shown, which is the same in the following), and ground line SL is connected to a negative electrode terminal of the battery.

Ignition switch 110 is provided between power supply line PL and ECU 80, and operated by a driver of the vehicle. Main relay 120 is provided between power supply line PL and ECU 80, and supplies/cuts off power from power supply line PL to ECU 80. Main relay 120 includes a contact 122 and a coil 124, and performs an on/off operation using magnetic force generated in coil 124 when a current flows through coil 124. That is, main relay 120 is turned on when a current flows through coil 124, and is turned off when a current does not flow through coil 124.

Ignition and injection relay 130 is provided between power supply line PL and ignition and injection devices 30 and 40, and supplies/cuts off power from power supply line PL to ignition device 30 and injection device 40. Ignition and injection relay 130 includes a contact 132 and a coil 134, and performs an on/off operation using magnetic force generated in coil 134 when a current flows through coil 134. Coil 134 has one end connected to a line connecting contact 122 of main relay 120 with ECU 80, and the other end connected to a ground node 150.

Ignition and injection relay 130 is driven by an output from main relay 120. That is, when main relay 120 is turned on, a current flows from main relay 120 into coil 134 of ignition and injection relay 130 to turn on ignition and injection relay 130. In addition, when main relay 120 is turned off, ignition and injection relay 130 is turned off because a current does not flow from main relay 120 to coil 134.

Ignition device 30 receives supply of operating power from power supply line PL via ignition and injection relay 130. Ignition device 30 includes an ignitor 32 and a spark plug 34. Ignitor 32 operates based on a control instruction from ECU 80 and boosts a voltage which is received from power supply line PL via ignition and injection relay 130. Spark plug 34 uses a boosted voltage boosted by ignitor 32 to generate a spark for firing the mixture.

Injection device 40 receives supply of operating power from power supply line PL via ignition and injection relay 130. Injection device 40 includes injectors 42 for respective cylinders of the engine. Each injector 42 operates based on a control instruction from ECU 80, and injects particles of fuel supplied from fuel pump 70.

Pump drive relay 140 is provided between ignition switch 110 and fuel pump 70, and supplies/cuts off power from power supply line PL to fuel pump 70. Pump drive relay 140 includes a contact 142 and a coil 144, and performs an on/off operation using magnetic force generated in coil 144 when a current flows through coil 144. Coil 144 has one end connected to ignition switch 110 and the other end connected to ECU 80.

Pump drive relay 140 can operate when ignition switch 110 is turned on, and is driven by ECU 80 when ignition switch 110 is turned on. When ignition switch 110 is turned off, pump drive relay 140 is also turned off in synchronization therewith.

Fuel pump 70, which is an electric pump, receives supply of operating power from power supply line PL via ignition switch 110 and pump drive relay 140 which are connected in series. When pump drive relay 140 is turned on based on an operation instruction from ECU 80, fuel pump 70 receives supply of power from pump drive relay 140 and operates to supply fuel inside fuel tank 50 to injection device 40.

ECU 80 receives accelerator press-down degree signal AP from accelerator pedal 95 and signal NE from engine 20 and, based on conditions such as a press-down degree of accelerator pedal 95 and a rotation speed of engine 20 respectively indicated with accelerator press-down degree signal AP and signal NE received, determines an opening degree of throttle valve 90, an ignition timing of ignition device 30 and an injection timing of injection device 40. Then, ECU 80 outputs opening degree instruction CTL to throttle valve 90 to control the opening degree of throttle valve 90, and also outputs control instructions corresponding to the ignition timing and the injection timing to respective ignition device 30 and injection device 40 to control driving of ignition device 30 and injection device 40. ECU 80 also outputs an operation instruction to pump drive relay 140 to drive fuel pump 70.

When ignition switch 110 is turned off by the driver of the vehicle, ECU 80 further performs stop control of engine 20. The stop control is to operate engine 20 for a prescribed period after ignition switch 110 is turned off in order to set an actuator which operates with an engine oil pressure (such as an intake and exhaust valve controlled with a VVT (Variable Valve Timing)) to a prescribed position for the next starting of the engine.

That is, when ignition switch 110 is turned off, ECU 80 further continues driving of ignition device 30 and injection device 40 for a predetermined prescribed time. After a lapse of the prescribed time, ECU 80 stops ignition device 30 and injection device 40 and stops feeding to coil 124 of main relay 120. With this, main relay 120 is turned off and feeding from power supply line PL to ECU 80 is cut off. That is, ECU 80 cuts off feeding from power supply line PL by itself.

During the stop control of engine 20, ECU 80 prohibits an update of accelerator press-down degree signal AP from accelerator pedal 95 to invalidate an operation of accelerator pedal 95, and outputs opening degree instruction CTL to throttle valve 90 to fix an opening degree of throttle valve 90. With this, a variation in an output of engine 20 due to pressing down of accelerator pedal 95 during the stop control of engine 20 is prevented. That is, while the driver of the vehicle understands that engine 20 is stopped by turning off ignition switch 110, the stop control of engine 20 is performed to operate engine 20 for a prescribed period after ignition switch 110 is turned off. Therefore, the driver with understanding as above may press down accelerator pedal 95 after turning off ignition switch 110. When accelerator pedal 95 is pressed down, throttle valve 90 opens to increase an intake amount of engine 20 and, since ignition device 30 and injection device 40 are operating, a rotation number of engine 20 is increased. Therefore, during the stop control of engine 20, an operation of accelerator pedal 95 is controlled to be invalidated to fix the opening degree of throttle valve 90, as described above.

As a method for invalidating the operation of accelerator pedal 95, in place of prohibiting an update of accelerator press-down degree signal AP, reception of accelerator press-down degree signal AP from accelerator pedal 95 may be prohibited, or accelerator press-down degree signal AP may be forcedly set to a minimum value thereof Furthermore, opening degree instruction CTL for throttle valve 90 may be fixed to a value at turning-off of ignition switch 110, or opening degree instruction CTL corresponding to a state in idling may be forcedly output regardless of a variation in accelerator press-down degree signal AP.

Though ECU 80 invalidates the operation of accelerator pedal 95 during the stop control of engine 20 to prevent a variation in the output of engine 20 due to pressing down of accelerator pedal 95, a variation in the output of engine 20 due to a variation in a load such as air conditioning, which is not caused by the operation of accelerator pedal 95, is permitted. With this, unintentional stall of engine 20 due to a variation in a load such as air conditioning is prevented.

It is to be noted that, ECU 80 corresponds to "control means" in the present invention.

In control device 100, when ignition switch 110 is turned off, pump drive relay 140 is correspondingly turned off and fuel pump 70 is stopped. Then, ECU 80 performs the stop control of engine 20 to further drive ignition device 30 and injection device 40 for a prescribed time. Though fuel pump 70 is already stopped during the stop control of engine 20, fuel corresponding to a residual pressure in delivery pipe 60 is supplied to injection device 40.

During performance of the stop control of engine 20, ECU 80 prohibits an update of accelerator press-down degree signal AP from accelerator pedal 95, generates opening degree instruction CTL of a constant value based on a fixed accelerator press-down degree signal AP, and outputs the generated opening degree instruction CTL to throttle valve 90.

After a lapse of the prescribed time from turning-off of ignition switch 110, ECU 80 stops operations of ignition device 30 and injection device 40 and stops feeding to coil 124 of main relay 120. With this, main relay 120 is turned off and ECU 80 performs self-shutting-off Then, ignition and injection relay 130 is turned off interlocked with turning-off of main relay 120, and feeding from power supply line PL to ignition device 30 and injection device 40 is cut off.

Figure 3:
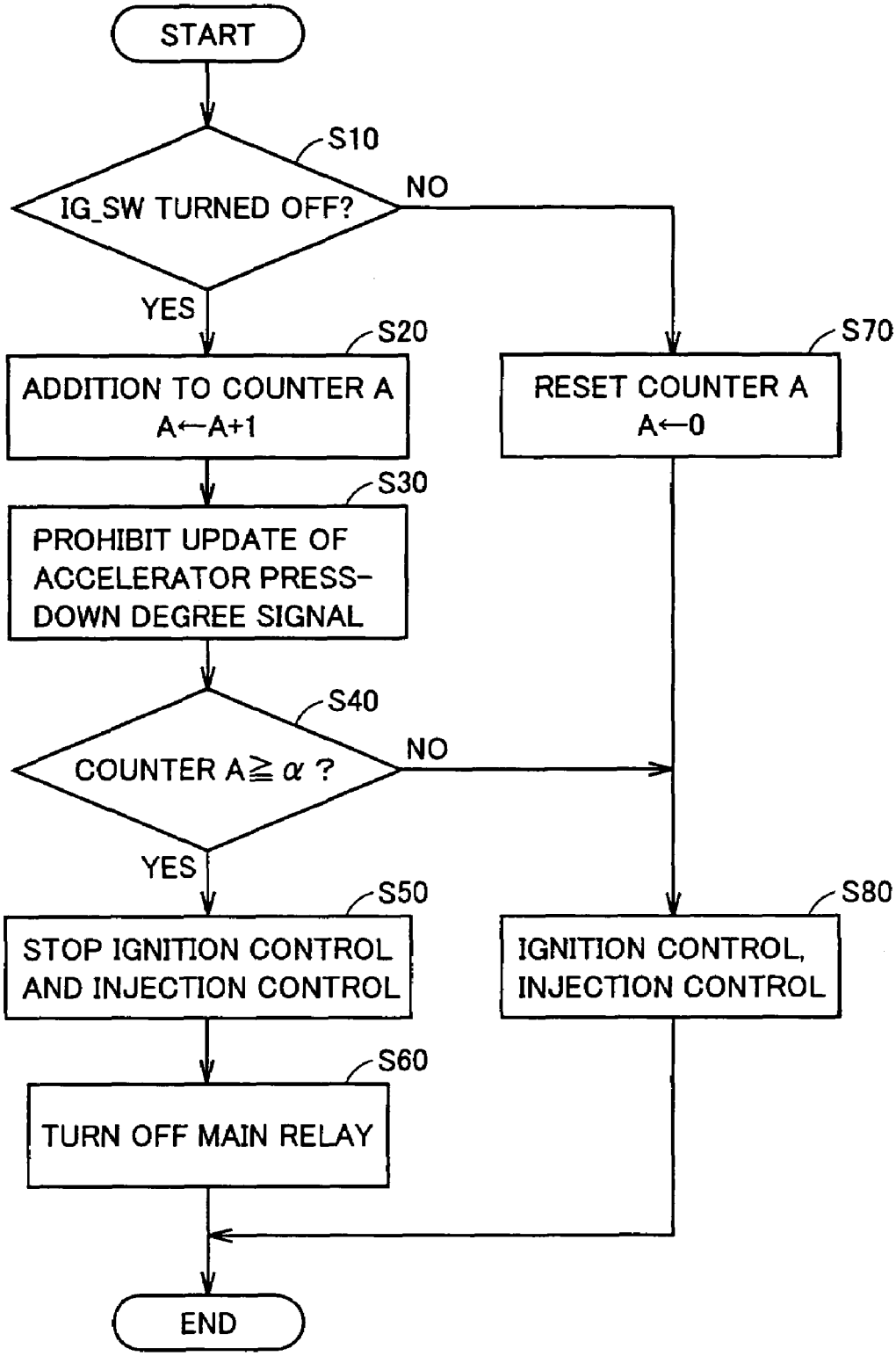
FIG. 3 is a flow chart of engine stop control performed by an ECU shown in FIG. 2.

FIG. 3 is a flow chart of the stop control of engine 20 performed by ECU 80 shown in FIG. 2. Processing according to the flow chart is performed in a predetermined cycle. Referring to FIG. 3, ECU 80 determines as to whether ignition switch 110 is turned off or not based on a potential of a connection line to ignition switch 110 (step S10). When it is determined that ignition switch 110 is not turned off (NO in step S10), ECU 80 resets a counter A to 0 (step S70). Counter A is a counter for measuring a performance time of the stop control of engine 20. When counter A is reset to 0, ECU 80 moves the processing to step S80.

On the other hand, when it is determined that ignition switch 110 is turned off in step S10 (YES in step S10), ECU 80 performs addition to counter A to measure a time elapsed from turning-off of ignition switch 110 (step S20). When ignition switch 110 is turned off, fuel pump 70 is stopped.

Then, to prevent a variation in the output of engine 20 due to an operation of accelerator pedal 95, ECU 80 prohibits an update of accelerator press-down degree signal AP received from accelerator pedal 95 and controls an opening degree of throttle valve 90 such that the opening degree of throttle valve 90 becomes constant regardless of an amount of pressing-down of accelerator pedal 95 (step S30).

ECU 80 then determines as to whether or not counter A added in step S20 is at least $\alpha$ value a which corresponds to a predetermined prescribed time (step S40). When it is determined that counter A is at least $\alpha$ (YES in step S40), ECU 80 stops outputting of control instructions to ignition device 30 and injection device 40 to stop ignition control by ignition device 30 and injection control by injection device 40 (step S50). Thereafter, ECU 80 turns off main relay 120 and performs self-shutting-off (step S60) to end a series of processing. As described above, when main relay 120 is turned off, ignition and injection relay 130 is turned off and feeding from power supply line PL to ignition device 30 and injection device 40 is cut off.

On the other hand, when it is determined that counter A is smaller than $\alpha$ in step S40 (NO in step S40), ECU 80 determines that the prescribed time has not been elapsed from turning-off of ignition switch 110, and continuously performs ignition control by ignition device 30 and injection control by injection device 40 (step S80).

It is to be noted that, in step S30 described above, ECU 80 may perform processing to prohibit reception of accelerator press-down degree signal AP or to forcedly set accelerator press-down degree signal AP to a minimum value thereof in place of prohibiting an update of accelerator press-down degree signal AP received from accelerator pedal 95, as described above. Alternatively, ECU 80 may perform processing to fix opening degree instruction CTL output to throttle valve 90 to a value at turning-off of ignition switch 110, or to forcedly output opening degree instruction CTL corresponding to a state in idling.

As described above, according to control device 100 in this embodiment, the stop control for operating engine 20 for a prescribed period is performed after ignition switch 110 is turned off. In control device 100, since the operation of accelerator pedal 95 is invalidated during the stop control of engine 20, the opening degree of throttle valve 90 is fixed and an output of engine 20 is not increased when the driver accidentally presses down accelerator pedal 95 during the stop control of engine 20 after ignition switch 110 is turned off Therefore, an overrun of the vehicle can be reliably prevented.

In addition, during the stop control of engine 20, since control device 100 permits a variation in an output of engine 20 due to a variation in a load such as air conditioning which is not caused by the operation of accelerator pedal 95, unintentional stall of the engine due to the variation in the load such as air conditioning can be prevented.

It is to be noted that, though the operation of accelerator pedal 95 is invalidated during the stop control of engine 20 to fix the opening degree of throttle valve 90 in the embodiment described above, the operation of accelerator pedal 95 may be invalidated to control to set a fuel injection timing and an amount of fuel injection from injection device 40 to constant values. Furthermore, injection device 40 may be controlled to stop fuel injection therefrom during the stop control of engine 20. With this, a variation in an output of an engine during stop control of the engine can also be prevented in an engine system having an output controlled by control of fuel injection.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A control device of an internal combustion engine having an output varying corresponding to an operation of an accelerator pedal, comprising:

control means for invalidating an operation of said accelerator pedal and controlling an opening degree of a throttle valve adjusting an intake amount of said internal combustion engine to a prescribed value other than zero during performance of stop control in which ignition control and injection control are carried out and said internal combustion engine is operated for a prescribed period even after an ignition switch is turned off.

2. The control device of an internal combustion engine according to claim 1, wherein said control means prohibits reception of an accelerator press-down degree signal varying corresponding to an amount of operation of said accelerator pedal during performance of said stop control.

3. A control device of an internal combustion engine having an output varying corresponding to an operation of an accelerator pedal, comprising:

control means for invalidating an operation of said accelerator pedal during performance of stop control for operating an internal combustion engine for a prescribed period after an ignition switch is turned off; and wherein said control means sets a value of an accelerator press-down degree signal varying corresponding to an amount of operation of said accelerator pedal to a minimum value during performance of said stop control.

4. The control device of an internal combustion engine according to claim 1, wherein said control means controls to set the opening degree of said throttle valve to a constant value during performance of said stop control.

5. The control device of an internal combustion engine according to claim 4, wherein said control means controls to set the opening degree of said throttle valve to a state at turning-off of said ignition switch during performance of said stop control.

6. A control device of an internal combustion engine having an output varying corresponding to an operation of an accelerator pedal, comprising:

control means for invalidating an operation of said accelerator pedal during performance of stop control for operating an internal combustion engine for a prescribed period after an ignition switch is turned off; and wherein said control means controls to set an opening degree of a throttle valve to a constant value during performance of said stop control;

wherein said control means controls to set the opening degree of said throttle valve to a state in idling of said internal combustion engine during performance of said stop control.

7. The control device of an internal combustion engine according to claim 1, wherein said control means controls to set an amount of injection of fuel supplied to said internal combustion engine to a constant value during performance of said stop control.

8. The control device of an internal combustion engine according to claim 1, wherein said control means stops injection of fuel supplied to said internal combustion engine during performance of said stop control.

9. A control device of an internal combustion engine having an output varying corresponding to an operation of an accelerator pedal, comprising:

a control portion invalidating an operation of said accelerator pedal and controlling an opening degree of a throttle valve adjusting an intake amount of said internal combustion engine to a prescribed value other than zero during performance of stop control in which ignition control and injection control are carried out and said internal combustion engine is operated for a prescribed period even after an ignition switch is turned off.

10. The control device of an internal combustion engine according to claim 9, wherein said control portion prohibits reception of an accelerator press-down degree signal varying corresponding to an amount of operation of said accelerator pedal during performance of said stop control.

11. A control device of an internal combustion engine having an output varying corresponding to an operation of an accelerator pedal, comprising:

a control portion invalidating an operation of said accelerator pedal during performance of stop control for operating an internal combustion engine for a prescribed period after an ignition switch is turned off; and wherein said control portion sets a value of an accelerator press-down degree signal varying corresponding to an amount of operation of said accelerator pedal to a minimum value during performance of said stop control.

12. The control device of an internal combustion engine according to claim 9, wherein said control portion controls to set the opening degree of said throttle valve to a constant value during performance of said stop control.

13. The control device of an internal combustion engine according to claim 12, wherein said control portion controls to set the opening degree of said throttle valve to a state of turning-off of said ignition switch during performance of said stop control.

14. A control device of an internal combustion engine having an output varying corresponding to an operation of an accelerator pedal, comprising:

a control portion invalidating an operation of said accelerator pedal during performance of stop control for operating an internal combustion engine for a prescribed period after an ignition switch is turned off;

wherein said control portion controls to set an opening degree of a throttle valve to a constant value during performance of said stop control; and wherein said control portion controls to set the opening degree of said throttle valve to a state in idling of said internal combustion engine during performance of said stop control.

15. The control device of an internal combustion engine according to claim 9, wherein said control portion controls to set an amount of injection of fuel supplied to said internal combustion engine to a constant value during performance of said stop control.

16. The control device of an internal combustion engine according to claim 9, wherein said control portion stops injection of fuel supplied to said internal combustion engine during performance of said stop control.

* * * * *